United States Patent [19]

Princevalle

[11] 4,280,044

[45] Jul. 21, 1981

[54] HEAT ABSORBING AND RADIATING DEVICE FOR ELECTRIC STOVES

[76] Inventor: Peter Princevalle, 5 E. Quail St., Sparks, Nev. 89431

[21] Appl. No.: 80,045

[22] Filed: Sep. 28, 1979

Related U.S. Application Data

[63] Continuation-in-part of Ser. No. 857,120, Dec. 5, 1977, abandoned.

[51] Int. Cl.[3] ..... H05B 3/68

[52] U.S. Cl. ..... 219/462; 126/39 J; 219/548; 219/530; 165/185

[58] Field of Search ..... 219/548, 530, 540, 546, 219/455–467, 449; 126/39 J; 165/185; 285/367, 365

[56] References Cited

U.S. PATENT DOCUMENTS

| | | | |
|---|---|---|---|
| 904,311 | 11/1908 | Crossan | 126/39 J |
| 1,797,102 | 3/1937 | Rossi | 126/215 |
| 2,696,654 | 2/1950 | Alsdorf | 219/463 |
| 3,067,811 | 12/1962 | Webster | 126/39 J |
| 3,941,117 | 3/1976 | Pei et al. | 126/39 J |

FOREIGN PATENT DOCUMENTS

| | | | |
|---|---|---|---|
| 100432 | 3/1922 | Switzerland | 219/430 |

*Primary Examiner*—Gene Z. Rubinson
*Assistant Examiner*—Bernard Roskoski
*Attorney, Agent, or Firm*—Mark C. Jacobs

[57] ABSTRACT

A heat absorbing and reflecting disc-shaped device having a flat top and a convex bottom and an irregular radially inward-extending cut-out and a plurality of randomly spaced throughbores, said disc being removably mounted on an electric range between the electric coil and reflector pan and resting on the latter. The device is preferably formed from a predetermined mixture of sand clay, water and sodium silicate and may be glazed, if desired. An irregular generally diamond-shaped central opening, preferably, is provided.

13 Claims, 6 Drawing Figures

HEAT ABSORBING AND RADIATING DEVICE FOR ELECTRIC STOVES

RELATIONSHIP TO OTHER APPLICATIONS

This application is a continuation in part of my copending application, Ser. No. 857,120, filed Dec. 5, 1977, now abandoned.

BACKGROUND OF THE INVENTION

1. Field of the Invention

The invention relates to heat absorbing and radiating devices; and, more particularly, to a ceramic heat absorbing and radiating device for use with electric stove heating elements.

2. BACKGROUND OF THE INVENTION

There has long been a need in electric stoves for elements which are able to transmit heat quickly from the electrical resistance element to the cooking utensil on the stove. Such an element should fit beneath the heating element of the stove and on top of the metal reflector pan, such as aluminum, to absorb heat and radiate it out well after the electricity has been turned off. Such an element should be easily removable for cleaning and servicing purposes and able to be reinstalled quickly and easily by a homemaker without the need for tools or the like. Such an element should be durable and long-lasting and economical in cost and ease of manufacture.

Although various such elements have been suggested, they are unsuitable for various reasons. For example, they may be integral with the electric heating element and of various metals or the like, as in U.S. Pat. No. 3,110,795 to Bremer. Certain elements, such as the ceramic element of Hess, are built into the range and thus difficult to remove and service (see U.S. Pat. No. 2,870,828). The unit of Rossi, U.S. Pat. No. 1,797,102, is intended for gas stoves due to the nature of its construction. In addition, it will not fit on the standard reflector.

SUMMARY OF THE INVENTION

It is an object of this invention to provide a heat absorbing and radiating device for an electric stove.

It is a further object of this invention to provide such a device which is disposed between the heating element and reflector pan and which rests upon the raised central section of the reflector.

It is still another object of this invention to provide an economic, durable heat absorbing and radiating element which efficiently absorbs and radiates heat in an electric range, and which is readily removable from the reflector.

These and other objects are preferably accomplished by providing a heat absorbing and reflecting device having a radially inwardly-extending irregular cut-out and a series of vertical spaced-apart throughbores, said disc-shaped device being mounted on an electric range between the electric coil and reflector pan and resting on the latter. The device is preferably formed from a predetermined mixture of sand clay, water and sodium silicate and may be glazed, if desired.

DESCRIPTION OF THE PREFERRED EMBODIMENT

Figure 1:
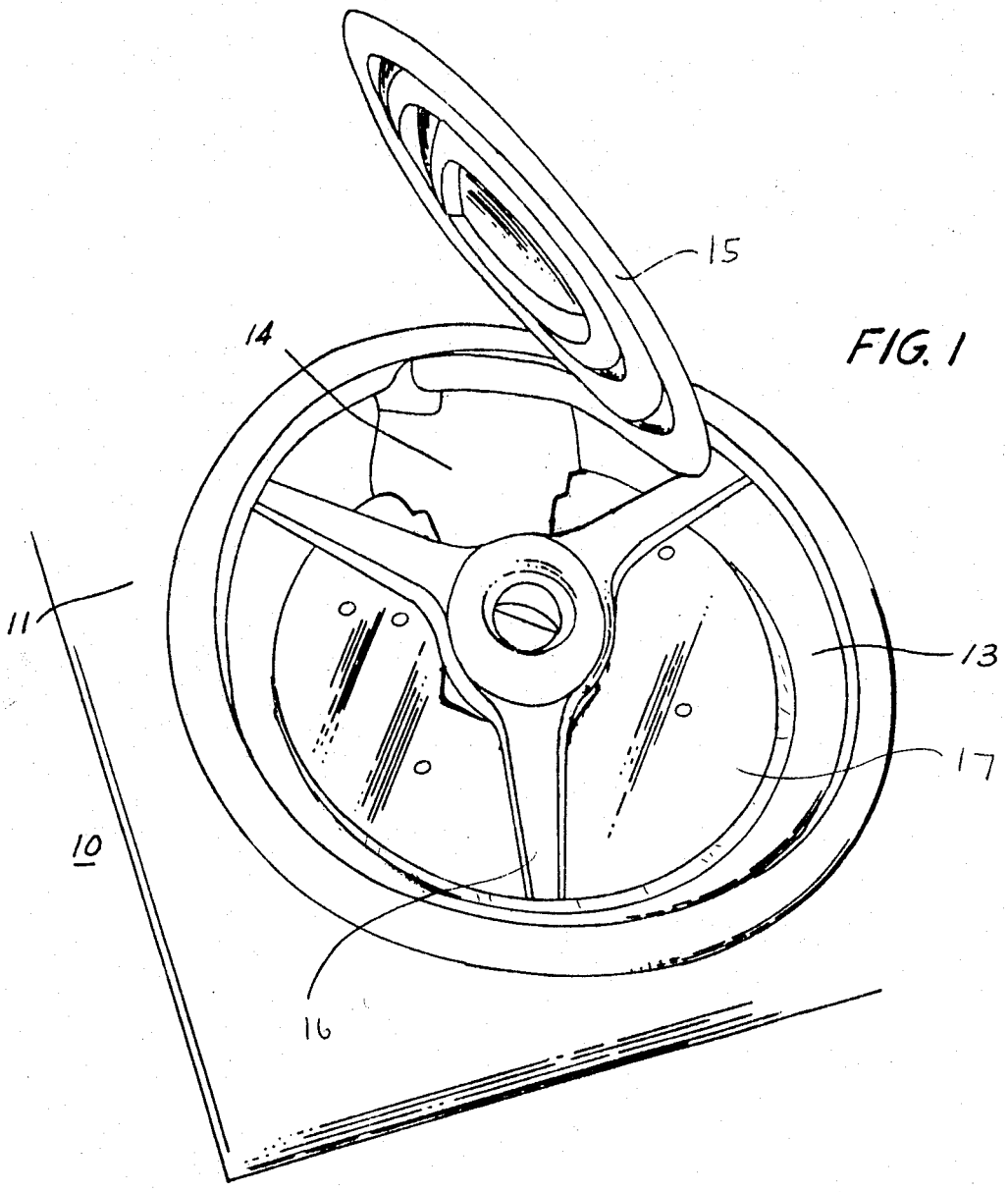
FIG. 1 is a perspective view of a portion of an electric range having a heat absorbing and radiating device in accordance with the invention installed therein.

Referring now to FIG. 1 of the drawing, a portion of a stove or range 10 is shown having an upper cooking surface 11 and at least one cooking section 12. Each section 12 includes a conventional reflector pan 13, which may be concave and arcuate with a cut-out portion 14 to accommodate the lead-in portion of a coiled heating element 15. Heating element 15 is shown in FIG. 1 in the raised position so as to illustrate the relationship of the various components. A Y-shaped support 16, spaced upwardly from reflector pan 13, is also provided on which element 15 sits. Below element 15, and resting on reflector pan 13, as particularly contemplated in the present invention, is a heat absorbing and radiating device 17.

Figure 2:
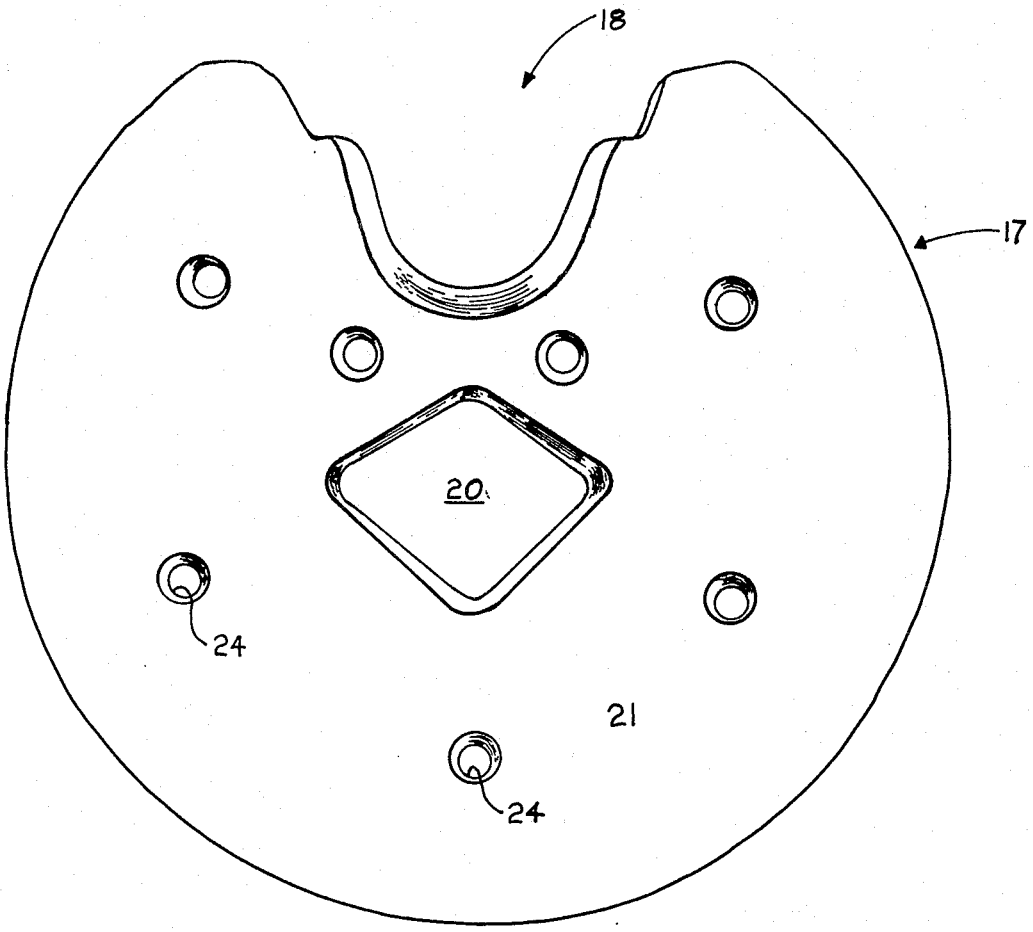
FIG. 2 is a top plan view of one embodiment of the heat absorbing and radiating device of FIG. 1.
Figure 3:
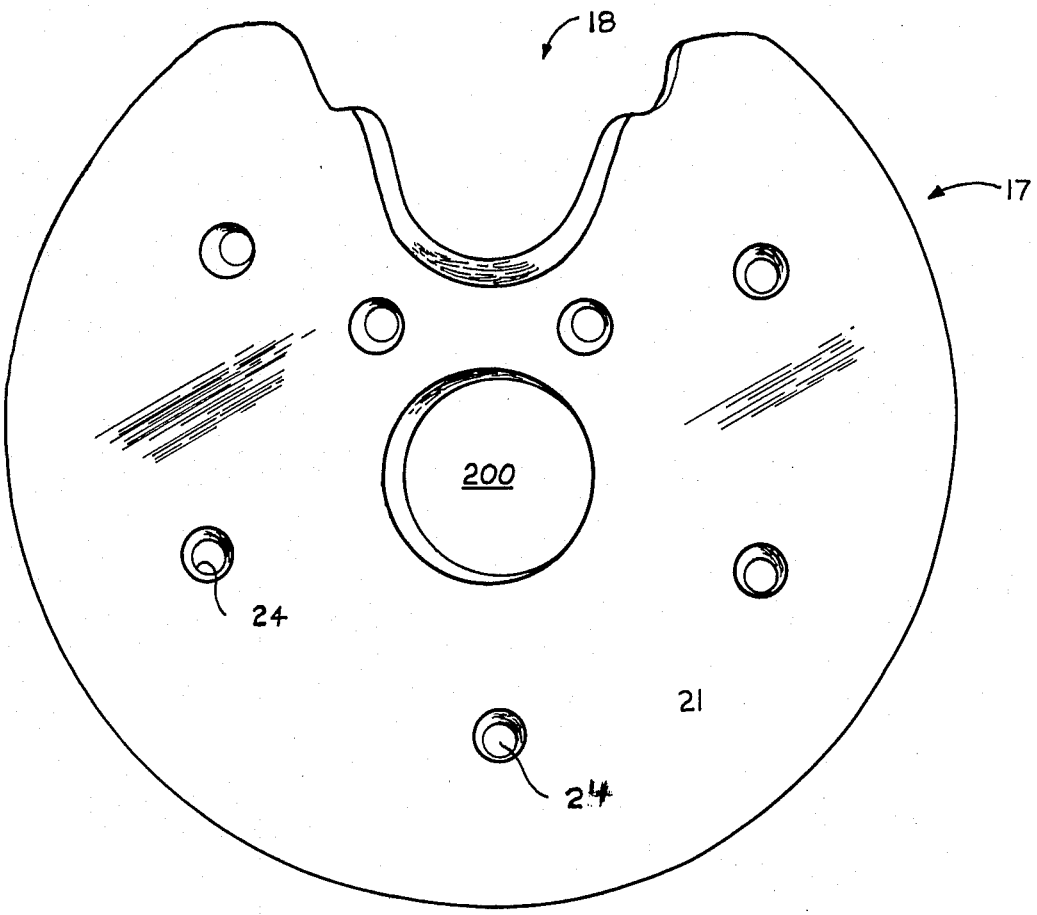
FIG. 3 is a top plan view of a second embodiment of the device shown in FIG. 1.
Figure 4:
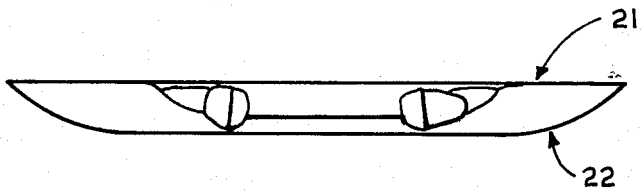
FIG. 4 is a view taken along lines 4—4 of FIG. 2.
Figure 5:
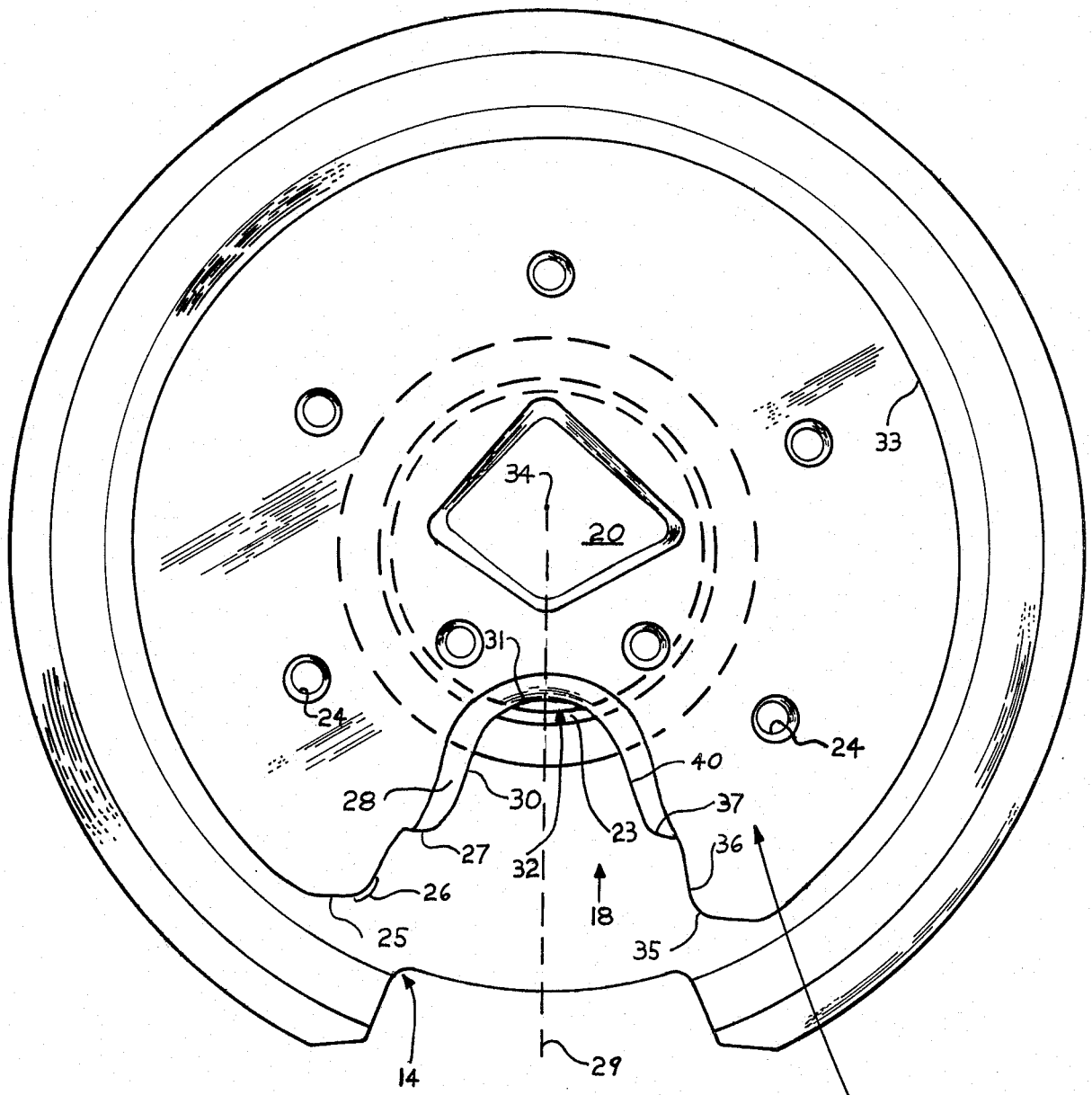
FIG. 5 is a close-up top plan view showing the device of FIG. 4 resting on the reflecting pan.

Device 17 is particularly shown in FIGS. 2 and 3. Device 17 is disc shaped ord has a cut-out portion 18, of irregular shape extending radially inward from the periphery toward the center as shown, so as to straddle the support post (not visible in FIG. 1) extending below the center of support 16 through the central hole 19 in pan 13. Thus, device 17 may include a central hole 20 and, as seen in FIG. 4, has a flat upper surface 21 and a convex bottom surface 22 so as to rest on concave reflector pan 13's upward-extending inner lip 23's edge. Thus, device 17 sits beneath heating coil element 15 and rests on top of reflector pan 13 (see FIG. 6). A series of spaced vertical throughbores 25 are provided, as will be discussed below.

The difference between the embodiments of FIGS. 2 and 3 lies solely in the configuration of the central hole 20.

Figure 6:
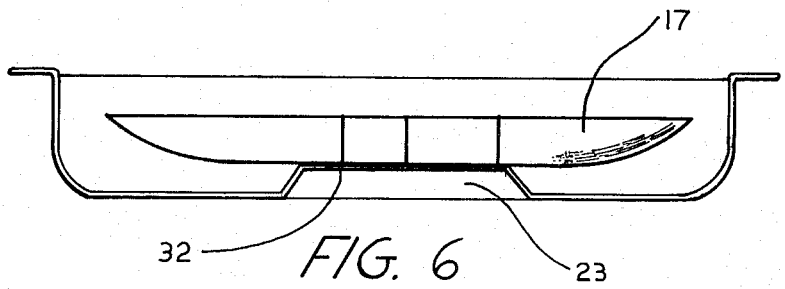
FIG. 6 is a section view taken along line 6—6 of FIG. 5.

As is seen in FIG. 6, the device of this invention rests upon the upraised centrally located lip 23 on the edge thereof 32. By resting on this lip, the device is brought into closer proximity to the calrod burner element than if it rested in the well of the reflector pan.

In detail it is seen that the irregular peripheral cutout 18 that extends radially inward has four differently extending portions on each side of an arcuate portion. Cutout section 18 has a first portion 25 extending from the periphery normal to an imaginary bisector 29 toward said bisector; a second portion 26 extending generally radially inward toward the center of said disc, from said first portion 25; a third portion 27 extending generally obliquely and inwardly from said second portion 26 toward the bisector; a fourth portion 30 extending inwardly from said third portion 27 toward the imaginary bisector and generally parallel to said second portion 26, and terminating at a fifth portion 31 which is arcuate; the junction of said third and fourth portions being slightly chamfered and said fifth portion commencing and terminating at points equidistant from the central axis of said disc.

Cutout 18 further includes a sixth portion 40, extending from said fifth portion generally outwardly and diagonally away from the imaginary bisector of said cutout 18. A seventh portion 37 extends obliquely from said sixth portion 40 outwardly away from said bisector to an eighth portion 36 which extends radially outwardly toward said periphery 33 to a ninth portion 35, which ninth portion extends normal to said bisector and terminates at the periphery. The junction of the sixth and seventh portions is slightly chamfered.

Taken together, portions 25, 26 and 27 and 35, 36 and 37 form a relatively wider outer opening 43 with their elevations intersecting the top 40 disc 17 at a right angle, whereas sections 30, 31 and 40 form a relatively narrower adjacent inner opening 44 whole elevational wall is hemispherical and designated 28.

The cutout 18 may be symmetrical about the imaginary bisector 29 through the center of the fifth portion and through the center of the space between the points where the first and ninth portions terminate at the periphery 33.

Disc 17 includes a plurality of randomly spaced throughbores 24 which allows for expansion due to heat absorption to prevent cracking of the disc.

A central hole 20, shown in FIG. 2 as generally diamond-shaped, is also provided. However, any configuration may be employed, such as round, provided that the area of said opening is smaller than the central opening 19 of reflector pan 13. If it is not, then device 17 cannot rest as desired on the edge 32 of lip 23. Such an alternate embodiment having a central round hold 200 is shown in FIG. 3.

Hole 20 is employed for expansion purposes and to allow air to pass entirely through the combination of the device 17 and pan 13. This is possible as the two holes align vertically when device 17 is properly disposed upon the lip 23 of the reflector 13.

I have found that the instant device is an improvement of that disclosed in my parent application previously cited, as the present configuration allows for better heat distribution, especially since the device 17 has a minimum contact area upon reflector pan 13.

Also, the randomly-spaced throughbores 24 are preferably symmetrically placed and preferably cone-shaped, and vary in diameter from about 10 mm. on top surface 21 down to about 7 mm. at bottom surface 22. Such a construction is beneficial for ease of manufacture, and the bores are employed to inhibit cracking of the device 17.

The provision of a curved edge for portions 30, 31 and 40 has been found to prevent chafing of the element on the instant device.

The composition of device 17 is an important feature of my invention. Device 17 is formed by mixing a predetermined quantity of Moroccan TM sand clay with water and sodium silicate, as, for example, about 100 pounds of sand clay, about 5.75 to 5.8 gallons of water and about 4.0 fluid ounces of sodium silicate. Preferably, the water is placed in a mixing vessel and the sodium silicate is mixed with a small quantity of water to dissolve the silicate. This mixture is then poured into the remaining water in the vessel while constantly mixing the same. The sand clay is then added a bit at a time with constant mixing. This mixture is then agitated in any suitable manner, such as an electric motor having mixing paddles extending down into the mixture in the vessel. The mixture is then poured into suitable molds and the molds are placed in a kiln or oven and fired at a temperature of about 2230° F. and for a time of about 10 hours (cone 6). A ratio of about 2 parts clay to 1 part water and about 0.005 parts sodium silicate gives a good quality product. The formed devices 17 are then cooled and removed from the molds. Preferably, the completed devices 17 may be glazed, as for example, by brushing with a conventional glaze, such as Mayco's black #250 glaze. The glazed devices 17 are then fired at a temperature of about 1900° F. (cone 06) for about eight hours to obtain a suitable black gloss. Of course, any suitable glaze of any desired color may be used. Glazing is preferred as it seals the unit.

While in the example aforesaid, sand clay has been named, it is understood that this is a generic material, and any type of said sand clay may be employed.

In my experience, I have found that black glaze provides the best insert, due to its inherent heat absorbing capability. However, I have found that other colors, including silver, which blends well with the coloration of the metal pan 13, may be employed with good results. Any suitable ceramic glaze may be used.

The devices of this invention have excellent heat absorbing and radiating abilities, are long lasting and durable, and easy to manufacture and install by the homemaker.

The insert device of this invention is safe to use and will not crack, even when subjected to boiling water from a teakettle while under its hottest operating conditions. Thus the housewife need not worry about injuries to children or herself. Of course, the device retains heat even after the coil, or burner or element,-all three terms being interchangeable-is turned off.

It is to be understood that, for optimum results, the insert 17 should be situated as close to the electric element 15 as possible. The closer the device is to the element 15, the faster the device will heat up, and it is believed that it will also heat hotter. The actual usage will depend on the distance of the pan 13 from the element 15. A distance of one to two inches is preferred.

In constructing the instant device, it has been found that a diameter of 6.25 inches and a depth of $\frac{5}{8}$ inch is suitable for use with the more or less standard large "burner" element 15.

In order to show the advantage of employing my insert, I used it in the preparation of various products that require long continuous cooking times. Thus, for making a corned beef, which I have found normally requires 25 minutes per pound to cook in boiling water at my local elevation, I have found that a total of 25 minutes can be saved on a 5-pound piece of meat when my device is employed in conjunction with a high heat burner. The temperature of the insert was found to be about 255°. In addition, it was necessary to lower the heat to a medium low or about 258° to prevent boiling over of the pot. By contrast, without my device, the heat was maintained at high throughout the cooking period.

In the preparation of spaghetti sauce, which requires a long simmering period, I found that the heat could actually be turned off and yet the sauce contained in the pan continued to cook solely from the heat being emitted from my device.

It is to be understood that short duration cooling is not to be carried out using the instant device, as some of the heat available is needed to warm the disc 17 toward a maximum temperature. Thus, a 3-minute egg may take 10 or more minutes. It is only after the device has been "charged" with heat, at least partially, that it becomes effective.

In order to test the effectiveness of the instant device and to dismiss all other variables as much as possible, two identical pot roasts were similarly prepared on the same stove, a Frigidaire Model RBH 533 CH.

EXAMPLE I

Two pieces, each three pounds, were cut from a six-pound chuck roast. Pot A was cooked on a large element with the instant device disposed upon the reflector pan. Pot B, an exact duplicate pot as A (both purchased new for this experiment) was employed without the instant device, also on a large element on the same stove. To each pot was added 5 carrots, 1 onion, 3 stalks of celery, 8 cups of cold water, ¼ pound of fresh mushrooms and ½ pound cut green beans.

Both pots were started at 2:20 p.m. on medium heat setting of the electric element. At 2:40 p.m. the heat of Pot A was turned down to between slow and simmer, and at 3:00 pm. it was turned down again to simmer until determined to be done at 5:30 p.m., a period of 2 hours and 30 minutes.

For Pot B, which was also started at 2:20 p.m. and kept at medium heat until 2:40 p.m., at 2:40 p.m. heat was turned down to low and at 3:00 p.m. to between low and simmer—one notch up for the second and third intervals over Pot A, thus using more energy. At 6:05 p.m., it was determined to be done to the same degree of doneness as the roast of Pot A. Total time: 2 hours and 55 minutes.

This shows both an energy saving for Pot A and a faster cooking time for this pot using the instant device thereunder.

EXAMPLE II

Two halves of three pounds each of a corned beef were placed in identical pots on the aforementioned stove. Pot A was used on the large element having one of the instant devices thereunder; Pot B did not. Each pot was filled with 12 cups of water and cooking was started at 1:20 p.m. at a medium high setting and allowed to proceed as such until 2:00 p.m. At this time, Pot A's setting was reduced to low. There was a soft boil, and the corned beef was pronounced cooked at 4:40 p.m.

For Pot B, the heat was turned down to low. The boiling was hard or rapid, and the meat was pronounced ready at 5:18 p.m.

It is believed that less time was required and that the boil was less intense, due to better heat distribution to the pot when the instant device was used.

EXAMPLE III

When two identical tomato sauces such as for spaghetti were prepared using a recipe that called for 4½ pounds of solid pack tomatoes, 6 ounces tomato paste and 6 ounces of mushrooms were simultaneously prepared, it was found that when identical heat temperatures were used that Pot A using the device having begun at 1:10 p.m. was ready at 5:30 p.m., while Pot B without the device started simultaneously was not ready until 6:15 p.m.

As alluded to previously, it is believed that the device of this invention contributes to a more even heat distribution over the pot. When the instant device is employed, the boiling when allowed to proceed is "soft," while when the device is not employed, there is a heavy or rapid boiling, such that liquid spills over under the lid and creates a mess on the stove top.

After applicant recognized the need for the instant device, an investigation was begun to determine why such a product had not been brought out previously. It was known that many stoves that were made in the early 1900's had used ceramic holders for the electrical coils of the elements. This was prior to the use of calrod elements. It was learned that the electrical coils were very fragile and had to be protected as well as insulated. Thus, while ceramic material was employed by such companies as L & H to separate the grid coils from each other, this ceramic was an insulator, not a heat absorber and radiator. Further investigation into products using calrod elements as made by Hotpoint-Hughes, Westinghouse and others led to the determination that the construction of the elements was such that the instant invention wouldn't have been imaginable as the cooking element was an integral unit with the reflector and not separateable therefrom in any manner.

A search of the patent literature failed to yield any device that can be inserted beneath an electric calrod cooking element, to rest upon the reflector which will absorb heat and deliver said heat to the pan on the element.

Since certain changes may be made in the above products and processes without departing from the scope of the invention herein involved, it is intended that all matter contained in the above description shall be interpreted as illustrative and not in a limiting sense.

I claim:

1. A heat absorbing and radiating device wherein said device comprises a ceramic disc having a flat top surface, a convex bottom surface, a central vertical hole therein, said hole being shaped sized to maintain said device positioned above a reflector pan and below a burner element of an electric range, and a plurality of spaced-apart cone shaped throughbores for inhibiting cracking of said disc, said disc having a cutout portion of irregular shape and spaced from said hole said cut out portion extending radially inward from the periphery of said disc said disc having a refractive glaze thereon.

2. In the device of claim 1 wherein the central hole is diamond-shaped.

3. In the device of claim 2 wherein said device is formed from a fired and cured mixture of sand clay, water and sodium silicate.

4. In the device of claim 3 wherein said irregular cutout comprises a relatively wider outer opening communicating with a relatively narrower adjacent inner opening.

5. In the device of claim 4 wherein the elevation of said inner opening is hemispherical.

6. In the device of claim 5 wherein said device's cutout is symmetrical about an imaginary bisector from the center of said disc.

7. In the device of claim 1 wherein said central hole is circular.

8. The heat absorbing and radiating device of claim 1 wherein the throughbores are symmetrically placed.

9. A heat absorbing and radiating device adapted for use in an electric range to be disposed upon the raised central lip of a metallic reflector, spaced down from the burner element, said device comprising:

a refractively glazed ceramic disc having a flat top surface and a convex bottom surface, a plurality of throughbores extending vertically through said device for inhibiting cracking of said device, an irregular symmetrical cut-out for passage of a burner element lead, said cut-out has a pair of four differently directioned extending portions, each adjoining the next, the last of which is on one side of an arcuate portion disposed therebetween, said cutout extending inwardly toward the center of said disc from the periphery thereof, said device also having a central hole therein and spaced from said cut-out, said hole being sized or shaped to maintain said disc positioned above a reflector pan and below said burner element of an electric stove.

10. A heat absorbing and radiating device adapted for use in an electric range, said device to be disposed upon the raised central lip of a metallic reflector spaced down from the burner element, said device comprising:

a refractively glazed ceramic disc having a flat top surface and a convex bottom surface, a plurality of throughbores extending vertically through said device;

said device having a central hole therein and an irregular peripheral cutout that extends radially inward, said cutout having a first portion extending from the periphery normal to an imaginary bisector toward said bisector; a second portion extending generally radially inward toward the center of said disc. from said first portion; a third portion extending generally obliquely and inwardly from said second portion toward the bisector; a fourth portion extending inwardly from said third portion toward the imaginary bisector and generally parallel to second portion, and terminating at a fifth portion which is arcuate; the junction of said third and fourth portions being slightly chamfered and said fifth portion commencing and terminating at points equidistant from the central axis of said disc;

a sixth portion extending from said fifth portion generally outwardly and diagonally away from the imaginary bisector of said cutout; a seventh portion extending obliquely from said sixth portion outwardly away from said bisector to an eighth portion which extends radially outwardly toward said periphery to a ninth portion, which ninth portion extends normal to said bisector and terminates at the periphery of said device, wherein the junction of said sixth and seventh portions is slightly chamfered.

11. The heat absorbing and radiating device of claim 10, wherein the elevation of said fifth portion is hemispherical.

12. The device of claim 11, wherein the cutout section is symmetrical about the imaginary bisector through the center of said fifth portion.

13. In an electric range having a plurality of burner elements having a metallic reflector pan spaced apart therefrom, and a heat absorbing and radiating ceramic device removably mounted on said reflector, said device being a disc having a flat top surface, a convex bottom surface, a central vertical hole therein, said hole being sized or shaped to maintain said disc positioned above said pan, and a plurality of spaced-apart throughbores for inhibiting cracking of said device, said disc having a cutout portion of irregular shape for allowing passage of lead positions of said burner elements, said cutout portion extending radially inward from the periphery of said disc.

* * * * *